US006863583B2

(12) United States Patent
Takahashi

(10) Patent No.: US 6,863,583 B2
(45) Date of Patent: Mar. 8, 2005

(54) SURFBOARD ASSEMBLY

(76) Inventor: Branden Takahashi, 4460 Panorama Dr., La Mesa, CA (US) 91941-5414

( * ) Notice: Subject to any disclaimer, the term of this patent is extended or adjusted under 35 U.S.C. 154(b) by 0 days.

(21) Appl. No.: 10/162,736

(22) Filed: Jun. 4, 2002

(65) Prior Publication Data

US 2003/0224676 A1 Dec. 4, 2003

(51) Int. Cl.[7] ..... B63B 35/79
(52) U.S. Cl. ..... 441/74
(58) Field of Search ..... 441/65, 70, 74, 441/76; 114/39.19; 280/611–163

(56) References Cited

U.S. PATENT DOCUMENTS

| | | | | |
|---|---|---|---|---|
| 2,276,826 A | | 3/1942 | Crowther | |
| 2,531,946 A | | 11/1950 | Parker | |
| 3,353,835 A | * | 11/1967 | Sommer | 280/612 |
| 3,437,345 A | | 4/1969 | Berta | |
| 3,628,804 A | * | 12/1971 | Carreiro | 280/18 |
| 3,667,771 A | | 6/1972 | Larson | |

(List continued on next page.)

FOREIGN PATENT DOCUMENTS

| | | | | |
|---|---|---|---|---|
| DE | 29722866 U1 | * | 2/1998 | A43B/1/14 |
| FR | 2696355 A1 | * | 4/1994 | A63C/9/00 |
| JP | 08191916 A | * | 7/1996 | A63C/9/00 |
| JP | 08215370 A | * | 8/1996 | A63C/9/00 |
| JP | 09192284 A | * | 7/1997 | A63C/9/00 |
| JP | 10314365 A | * | 12/1998 | A63C/9/86 |

*Primary Examiner*—S. Joseph Morano
*Assistant Examiner*—Ajay Vasudeva
(74) *Attorney, Agent, or Firm*—James P. Broder

(57) ABSTRACT

A surfboard assembly (10) includes at least two of a surfboard (12), a foot retainer (18) and a foot pad (16). The surfboard (12) includes a board apparatus (20) having a body region (34), a surface layer (36) and one or more board magnetic regions (14). The surface layer (36) is secured to the body region (34), and each board magnetic region (14) is secured to the board apparatus (20). Each board magnetic region (14) can have a substantially flat configuration and can be formed from a magnetic material. The board magnetic regions (14) can be secured to the surface layer (36) and/or the body region (34). The foot retainer (18) includes a retainer magnetic region (69) having a magnetic material. The foot retainer (18) can include a sole plate (62) that that couples the retainer magnetic region (69) to the retainer body (56). The foot pad (16) includes a pad region (46) and a pad magnetic region (48). The pad magnetic region (48) is secured to the pad region (46), and is substantially formed from a magnetic material. The surfboard (12), the foot retainer (18) and the foot pad (16) cooperate to assist an individual in maintaining his/her footing on the surfboard (12) during surfing.

36 Claims, 5 Drawing Sheets

U.S. PATENT DOCUMENTS 3,782,745 A * 1/1974 Stoveken ..... 280/18
3,927,897 A 12/1975 Olson et al.
3,960,383 A * 6/1976 O'Neil ..... 280/612
4,108,452 A * 8/1978 Baron ..... 280/11.3
4,285,082 A * 8/1981 Cox ..... 441/74
4,322,894 A * 4/1982 Dykes ..... 36/114
4,333,192 A * 6/1982 Stockli et al. ..... 12/142 E
4,645,466 A * 2/1987 Ellis ..... 441/74
5,018,760 A * 5/1991 Remondet ..... 280/609
5,024,611 A 6/1991 Eckerle et al.
5,205,071 A 4/1993 Hergenroeder
5,308,271 A 5/1994 Foulke
5,435,765 A 7/1995 Fletcher
5,454,743 A * 10/1995 Simonson ..... 441/74
5,473,963 A 12/1995 Aeschbach
5,704,256 A 1/1998 De Lattre
5,769,438 A 6/1998 Svetlov
5,807,019 A 9/1998 Meyer
5,865,446 A 2/1999 Kobylenski et al.
5,913,592 A * 6/1999 Moore ..... 36/8.1
5,954,357 A 9/1999 Golling
6,036,561 A * 3/2000 Fletcher ..... 441/70
6,151,807 A 11/2000 Qui et al.
6,183,000 B1 * 2/2001 Piatti ..... 280/610
6,224,086 B1 * 5/2001 Golling ..... 280/612
6,299,192 B1 * 10/2001 Bryce ..... 280/613
6,440,526 B1 * 8/2002 Gamble et al. ..... 428/100
2003/0075890 A1 * 4/2003 Jacobs ..... 280/87.042
2003/0211789 A1 * 11/2003 Taylor ..... 441/74
2004/0005825 A1 * 1/2004 Hasted ..... 441/65

* cited by examiner

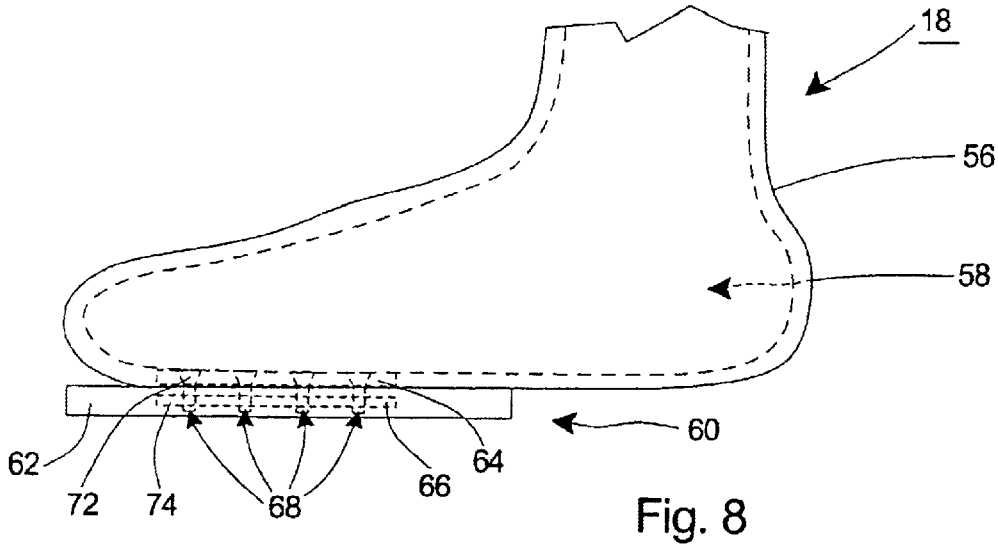
Fig. 8
Fig. 10
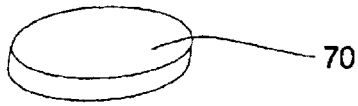
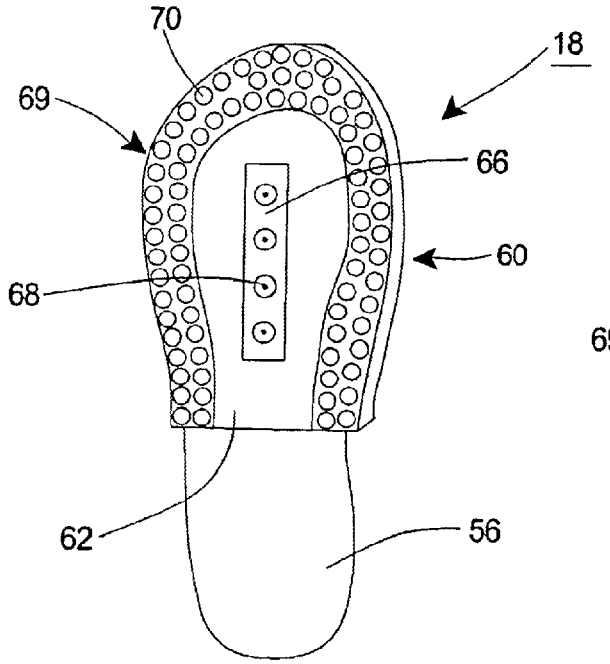
Fig. 9
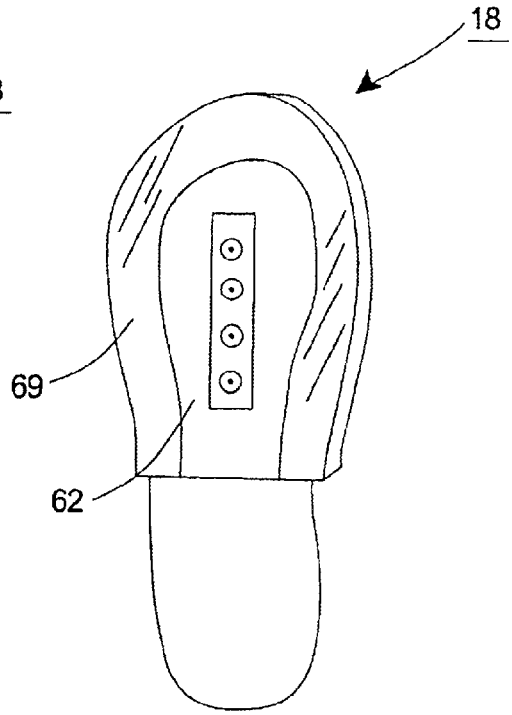
Fig. 11

SURFBOARD ASSEMBLY

FIELD OF THE INVENTION

The present invention relates generally to an assembly for releasably securing an individual to a surfboard.

BACKGROUND

People have long enjoyed the use of recreational devices such as surfboards in the ocean or other bodies of water. Over the years, increasingly intricate stunts using such devices have been developed. For example, it has become popular to use the crest of an ocean wave to propel an individual and his/her surfboard into the air to perform various aerial tricks. In addition, more and more surfers are riding extremely large waves. Unfortunately, the surfboard and the individual can become separated during such daring maneuvers. Moreover, lesser skilled individuals may find it difficult to keep their footing on the surfboard while attempting to ride a wave of any size. Further, the surfboard and the feet of the individual can become slick when wet, which can lead to slippage between the individual and the surfboard. An individual riding a wakeboard likewise can perform aerobatics that involve rotations, flips or other aerial stunts during which the rider can become separated from the wakeboard.

In light of the above, the need exists to provide a device that allows an individual to maintain his/her footing while using a surfboard. A further need exists to provide a device that facilitates learning to use such devices for the lesser-experienced surfer.

SUMMARY

The present invention is directed to a surfboard including a board apparatus having a body region, a surface layer and a board magnetic region. The surface layer is secured to the body region, and the board magnetic region is secured to the board apparatus. The board magnetic region is formed substantially from a magnetic material. In one embodiment, the board magnetic region is at least partially secured to the surface layer. Further, the board magnetic region can be at least partially secured to the body region. The board magnetic region can include a ferrous metal, and can have a substantially flat configuration. Additionally, the surfboard can include a plurality of spaced apart board magnetic regions that are secured to the board apparatus.

Additionally, the present invention is directed to a foot retainer that retains a foot of an individual. The foot retainer includes a retainer body and a retainer magnetic region having a magnetic material. The foot retainer can also include a sole plate that couples the retainer magnetic region to the retainer body.

Further, the present invention is directed to a foot pad for a surfboard, the foot pad that includes a pad region and a pad magnetic region. The pad magnetic region is secured to the pad region, and is substantially formed from a magnetic material.

The present invention is also directed to a method for surfing, and a surfboard assembly that includes at least two of: a surfboard, a foot pad that is secured to the surfboard, and a foot retainer.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which:

FIG. 8 is a side view of an embodiment of the foot retainer having features of the present invention;

FIG. 9 is a bottom view of a first embodiment of the foot retainer in FIG. 8 including a plurality of magnets;

FIG. 10 is a perspective view of an embodiment of one of the magnets;

FIG. 11 is a bottom view of a second embodiment of the foot retainer in FIG. 8;

DESCRIPTION

Figure 1:
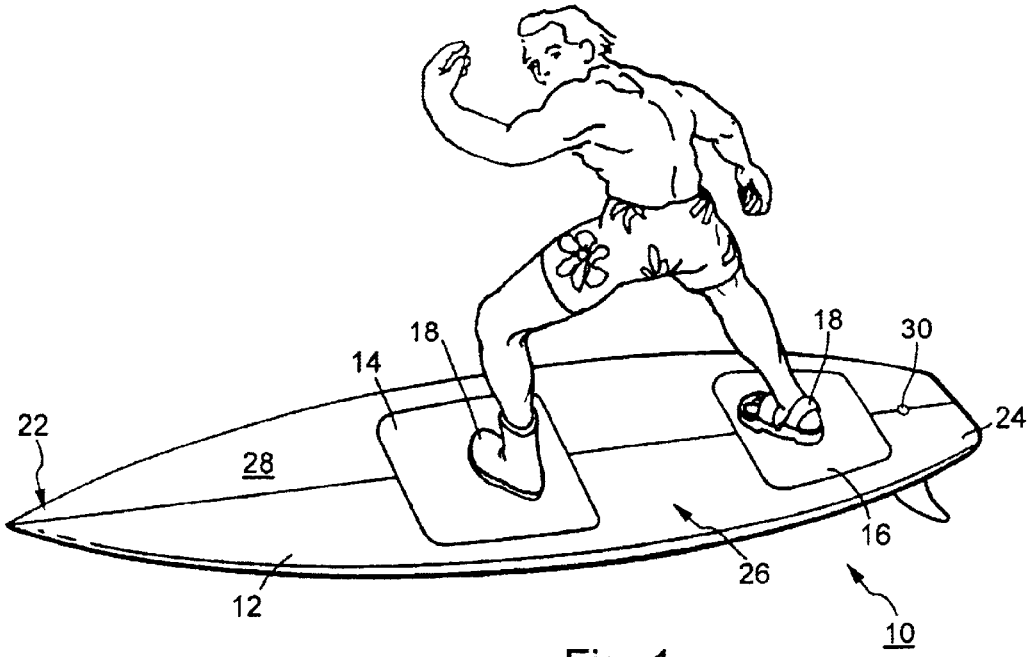
FIG. 1 is a perspective view of an embodiment of a surfboard assembly including a surfboard, a foot pad and a plurality of foot retainers, having the features of the present invention.

FIG. 1 is a perspective view of an embodiment of a surfboard assembly 10 having features of the present invention. In this embodiment, the surfboard assembly 10 includes (i) a surfboard 12 having one or more board magnetic regions 14, (ii) one or more foot pads 16, and (iii) one or more foot retainers 18. In some embodiments, the surfboard assembly 10 need not include all of the foregoing elements.

The surfboard 12 supports an individual on or near the surface of water. The design of the surfboard 12, including the shape, particular dimensions and materials used to form the surfboard 12, can be varied. In the embodiment illustrated in FIG. 1, the surfboard 12 includes a board apparatus 20 having a front section 22, a rear section 24, a middle section 26, a top board surface 28, a spaced apart bottom board surface 29 (illustrated in FIG. 3) and a leash retainer 30. The surfboard 12 also includes the board magnetic region(s) 14. In FIG. 1, the front section 22 is generally V-shaped, and normally points in the direction of travel in the water. The rear section 24 is located on the opposite end of the surfboard from the front section 22. The middle section 26 is positioned between the front section 22 and the rear section 24. The top board surface 28 provides a deck on which the individual can stand, sit or lie while in the water. The bottom board surface is opposite the top board surface 28, and generally faces the water during surfing. The leash retainer 30 retains a leash (not shown) which can be secured to the individual's leg while surfing.

The board magnetic region 14 can magnetically interact with the foot pad 16, the foot retainer 18, or both, in order to form a magnetic attraction between the surfboard 12 and the foot pad 16 and/or the foot retainer 18. The design of the board magnetic region 14 can be varied to suit the design requirements of the foot pad 16, the foot retainer 18 and/or the individual. In one embodiment, the board magnetic region 14 is formed at least partially from a magnetic material that can be magnetically attracted to the foot pad 16 and/or the foot retainer 18. In an alternate embodiment, the board magnetic region 14 is formed at least partially from a magnet that magnetically attracts the foot pad 16 and/or the foot retainer 18 to the board magnetic region 14. As used herein, "magnetic material" is material that can have the properties of a magnet, or that can be capable of being magnetized or attracted by a magnet.

Further, the number of board magnetic regions 14 can be varied. In the embodiment illustrated in FIG. 1, the surfboard 12 includes one board magnetic region 14. In alternate embodiments, the surfboard 12 can include greater or fewer than one board magnetic region 14.

Figure 2:
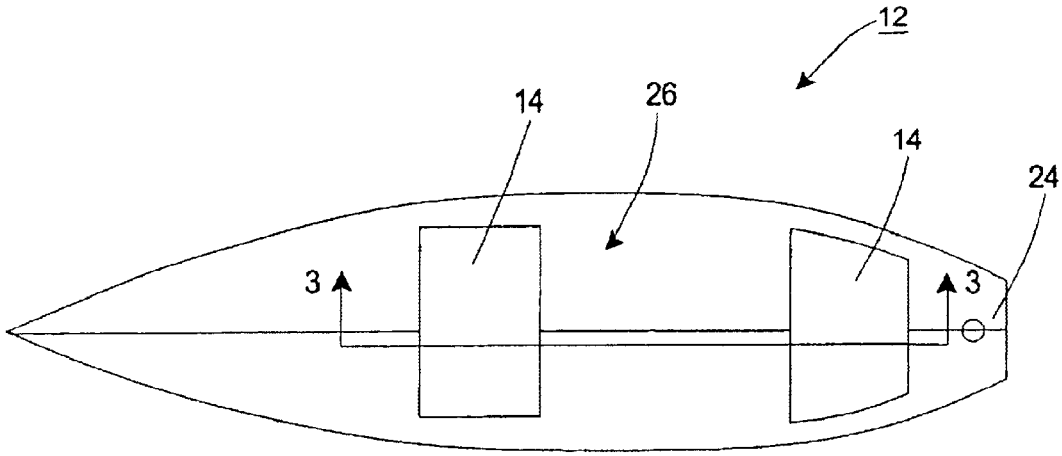
FIG. 2 is a top view of an embodiment of the surfboard having features of the present invention.

FIG. 2 illustrates a top view of the surfboard 12 having two substantially planar board magnetic regions 14. The size and configuration of each board magnetic region 14 can vary depending upon the positioning of the board magnetic region 14. For example, in embodiments that utilize the board magnetic region 14 near the rear section 24 of the surfboard 12, the board magnetic region 14 can be somewhat trapezoidal. FIG. 2 also illustrates one of the board magnetic regions 14 having a substantially rectangular configuration when positioned toward the middle section 26 of the surfboard 12. In alternative embodiments, the board magnetic regions 14 can be square, round, elliptical, triangular, or in any other suitable geometric shape. Further, each board magnetic region 14 can have a random or semi-random configuration. The board magnetic regions 14 shown in FIG. 2 are for illustrative purposes only, and should not be construed to limit the shape, size or positioning of the board magnetic regions 14 on or within the surfboard 12.

Figure 3:
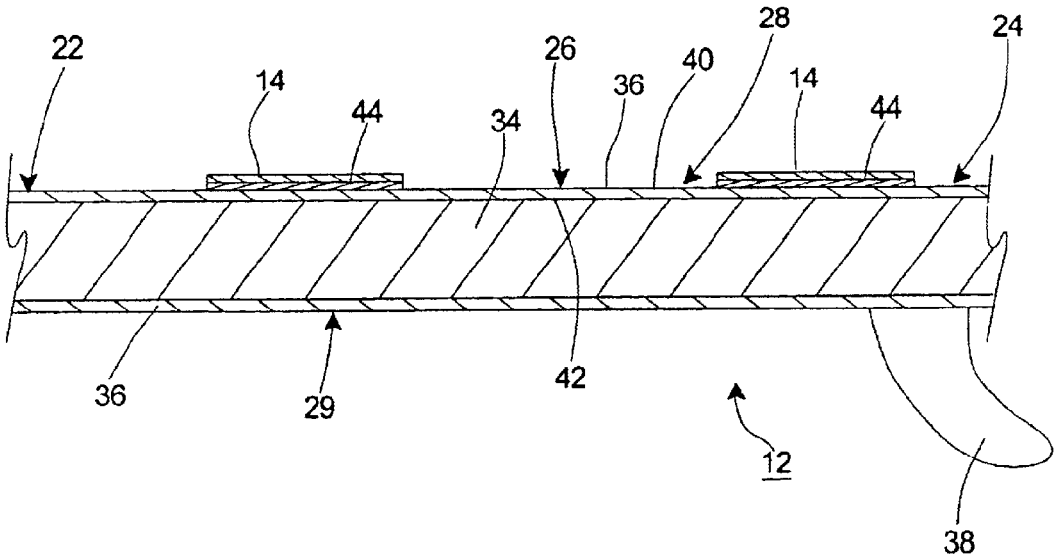
FIG. 3 is a partial cross-sectional view of the surfboard taken on line 3—3 of FIG. 2.

FIG. 3 illustrates a partial cross-sectional view of the surfboard 12 shown in FIG. 2. In the embodiment shown in FIG. 3, the surfboard 12 includes a body region 34, a surface layer 36, a fin 38 and two board magnetic regions 14. In this embodiment, the body region 34 is substantially encircled by the surface layer 36. The composition of the body region 34 can vary. For example, the body region 34 can include a somewhat rigid foam material that forms a relatively lightweight core of the surfboard 12. Alternately, the body region 34 can include wood or plastic materials. Still alternately, the body region 34 and the surface layer 36 can be a unitary structure. For example, the body region 34 and the surface layer 36 can be formed from one or more sections of wood. The dimensions of the body region 34 can vary widely depending upon the design requirements of the surfboard 12. For example, the body region 34 can have a length of up to or exceeding four meters. Somewhat similarly, the body region 34 has a thickness that can vary along the length of the body region 34. For instance, the thickness of the body region 34 can be greater toward the middle section 26 of the surfboard 12 than toward the front section 22 or the rear section 24.

The surface layer 36 can be constructed of different materials, which can include fiberglass, various plastics or other resins, as examples. The surface layer 36 can completely enclose the body region 34 to inhibit water from contacting the body region 34. The surface layer 36 includes a first surface 40 that is exposed and does not contact the body region 34, and a second surface 42 that is not exposed and substantially contacts the body region 34. The thickness of the surface layer 36 can vary, but is often between approximately 2 millimeters and 5 millimeters, although surface layers 36 outside this range can be used.

The fin 38 generally downwardly depends from the first surface 40 of the surface layer 36 on the bottom board surface 29 of the surfboard 12. The fin 38 guides movement of the surfboard 12 while the surfboard 12 is in the water. The shape and size of the fin 38 can vary, as can the number of fins 38 on the surfboard 12. For example, the surfboard 12 can include two fins 38 or three fins 38.

In the embodiment illustrated in FIG. 3, the board magnetic regions 14 are secured to the first surface 40 of the surface layer 36 on the top board surface 28. In this embodiment, the board magnetic regions 14 are coupled to the first surface 40 with a contact layer 44, which can include an adhesive, for example. The contact layer 44 can include any suitable materials for securing the board magnetic region 14 to the first surface 40. Alternately, the board magnetic regions 14 can be adhered directly to the first surface 40, omitting the contact layer 44. Still alternately, the board magnetic regions 14 can be coupled to the surface layer 36 by another suitable material.

Each board magnetic region 14 can be formed from magnetic materials that readily interact with a magnet so that a magnetic attraction results between the board magnetic region 14 and the magnet. For example, ferrous metal and/or various alloy metals can be used to form the board magnetic region 14. Alternatively, certain ceramics or other suitable materials can be included in the board magnetic region 14, provided a sufficient magnetic attraction between the board magnetic region 14 on the one hand, and the foot pad 16 (illustrated in FIG. 1) and/or the foot retainer 18 (illustrated in FIG. 1) on the other hand, occurs.

In an alternate embodiment, the board magnetic region 14 can be formed at least partially from a temporary or a permanent magnet that magnetically attracts the foot pad 16 and/or the foot retainer 18. For example, the board magnetic region 14 can include a magnet formed from a ferrous metal, a nickel-cobalt alloy, or other suitable materials.

The board magnetic region 14 has a thickness that can vary depending upon the magnetic requirements of the surfboard 12. For example, the thickness of the board magnetic region 14 can be approximately 26-gauge material. Alternately, the thickness of the board magnetic region 14 can be greater or less than 26-gauge material. Still alternately, the board magnetic region can have any thickness that is between approximately 0.5 millimeters and 10 millimeters. In alternate embodiments, the thickness can be outside this range.

Figure 4:
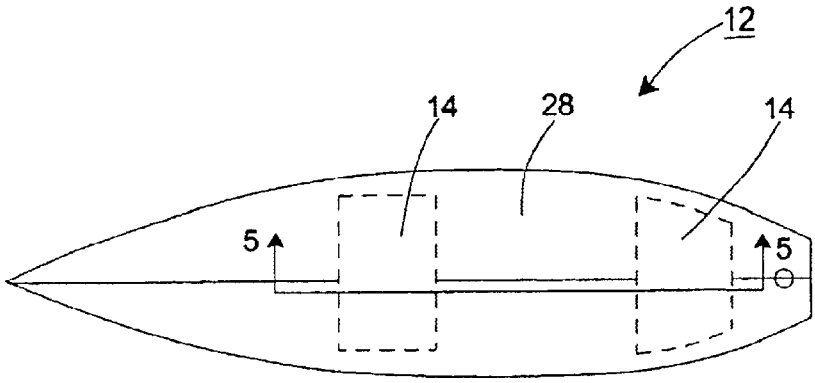
FIG. 4 is another embodiment of the surfboard having features of the present invention.

FIG. 4 illustrates another embodiment of the surfboard 12 including the board magnetic regions 14 (shown in phantom). In this embodiment, the board magnetic regions 14 do not contact the top board surface 28 of the surfboard 12. Rather, each board magnetic region 14 is positioned beneath the top board surface 28 so that no portion of the board magnetic region 14 is exposed. Further, the positioning of one board magnetic region 14 can vary relative to the positioning of any other board magnetic region 14.

Figure 5:
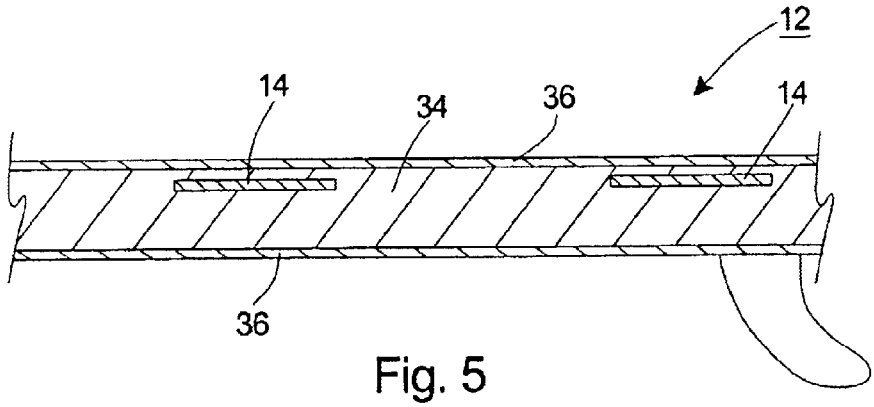
FIG. 5 is a partial cross-sectional view of the surfboard taken on line 5—5 of FIG. 4.

FIG. 5 is a partial cross-sectional view of the surfboard 12 illustrated in FIG. 4. In this embodiment, the board magnetic region 14 can be positioned partially or entirely within the body region 34 of the surfboard 12. Alternately, the board magnetic region 14 can be positioned entirely within the surface layer 36, so that the surface layer 36 encloses the board magnetic region 14. However, each board magnetic region 14 can be positioned to contact both the body region 34 and the surface layer 36.

Figure 6:
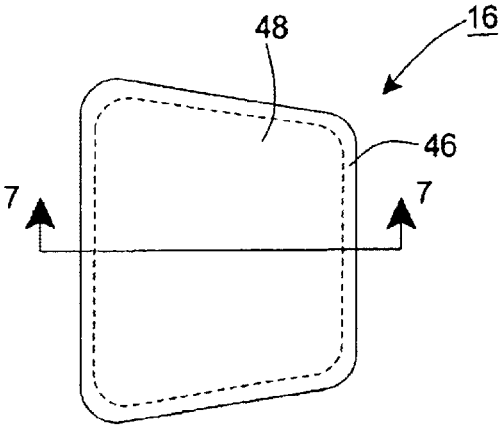
FIG. 6 is a top view of the foot pad having features of the present invention.

FIG. 6 illustrates an embodiment of the foot pad 16. The foot pad 16 magnetically interacts with the board magnetic region(s) 14 (Illustrated in FIG. 1) of the surfboard 12 (illustrated in FIG. 1) and/or the foot retainer 18 (illustrated in FIG. 1) so that a magnetic attraction is formed. The design of the foot pad 16 can be varied. The foot pad 16 includes a pad region 46 and a pad magnetic region 48 (shown in phantom). The pad region 46 can be formed from a resilient material such as neoprene, plastic, rubber or other suitable non-slip materials.

The pad magnetic region 48 can be formed from magnetic materials that readily interact with a magnet so that a magnetic attraction results between the pad magnetic region 48 and the magnet. For example, ferrous metal and/or various alloy metals can be used to form the pad magnetic region 48. Alternatively, certain ceramics or other suitable materials can be included in the pad magnetic region 48, provided a sufficient magnetic attraction between the pad magnetic region 48 on the one hand, and the board magnetic region 14 and/or the foot retainer 18 on the other hand, occurs.

In an alternate embodiment, the pad magnetic region 48 can include a temporary or a permanent magnet that magnetically attracts the board magnetic region 14 and/or the foot retainer 18. For example, the pad magnetic region 48 can include a magnet formed from a ferrous metal, a nickel-cobalt alloy, or other suitable materials.

Figure 7A:
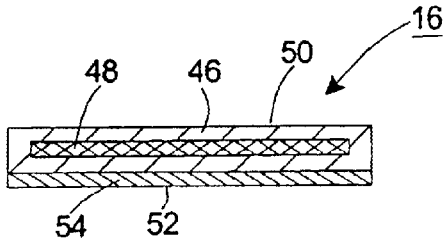
FIG. 7A is a cross-sectional view of an embodiment of the foot pad taken on line 7—7 of FIG. 6.

FIG. 7A is a cross-sectional view of one embodiment of the foot pad 16. The positioning of the pad region 46 relative to the pad magnetic region 48 can vary. The foot pad 16 includes an upper pad surface 50 and a lower pad surface 52. In this embodiment, the pad magnetic region 48 is substantially enclosed by the pad region 46. Further, the foot pad 16 can include other means for securing the foot pad 16 to the surfboard 12 (illustrated in FIG. 1). For example, the foot pad 16 can include an adhesive layer 54 that can adhere the foot pad 16 to the top board surface 28 (illustrated in FIG. 1) of the surfboard 12. Alternately, the foot pad 16 and the surfboard 12 can utilize synthetic materials that adhere when pressed together, which can include materials commonly sold under the trademark "Velcro". For example, such materials can include loop and pile or hook and pile fastening materials (not shown). In embodiments in which the foot pad 16 magnetically interacts with the board magnetic region 14 Illustrated in FIG. 1), it would not be necessary to include another material for securing the foot pad 16 to the surfboard 12.

The pad magnetic region 48 has a thickness that can vary depending upon the design requirements of the surfboard 12 and/or the foot retainer 18. For example, the thickness of the pad magnetic region 48 can be approximately 1–3 millimeters. In alternate embodiments, the thickness of the pad magnetic region 48 can be greater or less than 1–3 millimeters.

Figure 7B:
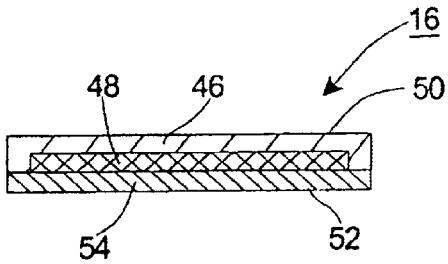
FIG. 7B is cross-sectional view of another embodiment of the foot pad taken on line 7—7 of FIG. 6.

FIG. 7B is a cross-sectional view of another embodiment of the foot pad 16. In this embodiment, the pad magnetic region 48 is not substantially enclosed by the pad region 46. The degree to which the pad magnetic region 48 contacts or is enclosed by the pad region 46 can be varied. As illustrated in FIG. 7B, the pad magnetic region 48 is only partially enclosed by the pad region 46. For example, the pad magnetic region 48 and the pad region 46 are positioned so that the upper pad surface 50 is substantially formed from part of the pad region 46, and the lower pad surface 52 is formed substantially from part of the pad magnetic region 48 or an adhesive layer 54 as illustrated in FIG. 7B.

FIG. 8 illustrates one embodiment of the foot retainer 18. In this embodiment, the foot retainer 18 magnetically interacts with the pad magnetic region 48 (illustrated in FIG. 1) of the foot pad 16 (illustrated in FIG. 1) and/or the board magnetic region 14 (illustrated in FIG. 1) of the surfboard 12 (illustrated in FIG. 1) to generate a magnetic attraction between two or more of these structures. The design of the foot retainer 18 can be varied to suit the design requirements of the individual, the foot pad 16 and the surfboard 12. In the embodiment illustrated in FIG. 8, the foot retainer 18 includes a retainer body 56 that defines a retainer body cavity 58, and a sole region 60. The retainer body 56 can be sized to fit over one foot of the individual. The retainer body 56 can utilize a zipper (not shown) or a loop and pile strap (not shown) to ensure the foot retainer 18 remains on the foot of the individual as long as necessary. The retainer body 56 can be formed from resilient materials such as neoprene or other rubberized insulating materials, for example.

The design of the sole region 60 can be varied. In the embodiment illustrated in FIG. 8, the sole region 60 includes a sole plate 62, a first mounting bracket 64 (shown in phantom) and a second mounting bracket 66 (shown in phantom), and one or more fastener assemblies 68 (shown in phantom). The sole plate 62 is secured to the retainer body 56 using the mounting brackets 64, 66 and the fastener assemblies 68.

In this embodiment, the first mounting bracket 64 is positioned internally within the retainer body cavity 58, and the second mounting bracket 66 is positioned external to the retainer body cavity 58 so that the sole plate 62 is located substantially between the second mounting bracket 66 and the retainer body 56. In alternate embodiments, the sole region 62 can include greater or fewer than two mounting brackets 64, 66. Each mounting bracket 64, 66 can be formed from plastic, metal, or other sufficiently rigid materials that facilitate secure attachment of the sole plate 62 to the retainer body 56.

Each fastener assembly 68 can include an externally threaded member 72 and an internally threaded member 74 that fits onto the externally threaded member 72. For example, the fastener assembly 68 can include an externally threaded bolt and an internally threaded nut. Alternatively, other suitable fastener assemblies 68 can be used provided the sole plate 62 is securely fastened to the retainer body 56. In this embodiment, four fastener assemblies 68 are used. However, it is recognized that any suitable number of fastener assemblies 68 can be incorporated into the sole region 60. Moreover, although the fastener assemblies 68 are positioned so that the internally threaded members 74 are external to the retainer body cavity 58, the positioning of the fastener assemblies 68 can be reversed so that the internally threaded members 74 are located within the retainer body cavity 58.

FIG. 9 is a bottom view of an embodiment of the foot retainer 18 including the retainer body 56 and the sole region 60. As illustrated in FIG. 9, the sole region 60 also includes a retainer magnetic region 69 that includes a plurality of magnets 70. Further, the sole plate 62 can couple the retainer magnetic region 69, including the magnets 70, to the retainer body 56. The sole plate 62 can be shaped and sized depending upon the requirements of the retainer body 56. For instance, the sole plate 62 can be generally flat, and can be semi-circular, round, or any other suitable configuration.

The sole plate 62 can be formed from sufficiently rigid materials such as plastic, fiberglass or various resins, as examples.

The magnets 70 magnetically interact with the foot pad 16 (illustrated in FIG. 1) and/or the surfboard 12 (illustrated in FIG. 1) to form a magnetic attraction. The strength of the magnetic attraction can be varied to suit the requirements of the individual using the surfboard assembly 10. For example, the number, size and positioning of the magnets 70 included in the foot retainer 18 can vary to either increase or decrease the level of magnetization as desired. With this design, the individual wearing the foot retainer(s) 18 can perform various aerobatic stunts while surfing, while the magnetic attraction described herein inhibits separation between the foot retainer 18 and the surfboard 12 and/or the foot pad 16. Further, the magnets 70 can be removable, so that the magnetization level can be adjusted for individuals of different sizes or skill levels, or for varying degrees of difficulty in the aerial tricks being attempted.

The magnets 70 can be secured to the sole plate 62 in a number of different ways. For example, the magnets 70 can be secured to the sole plate 62 with an adhesive material such as an epoxy. Any suitable method of securing the magnets 70 to the sole plate 62 can be used, provided that such method is not substantially compromised by contact with seawater. Additionally, the positioning of the magnets 70 on the sole plate 62 can be varied. Although the magnets 70 are shown somewhat in a horseshoe orientation in FIG. 9, any suitable orientation can be used.

FIG. 10 is a perspective view of an embodiment of one of the magnets. The magnets 70 illustrated in the embodiment in FIG. 10 are disc-shaped. Other shapes can be used, however. In this example, the magnets 70 have a thickness of approximately 2.5 millimeters, and a diameter of approximately 9.0 millimeters. It is recognized, however, that any appropriately sized magnet 70 can be incorporated into the foot retainer 18.

In an alternate embodiment illustrated in FIG. 11, the foot retainer 18 includes a retainer magnetic region 69 that includes a magnetic material. The retainer magnetic region 69 is attracted to the pad magnetic region 48 (illustrated in FIG. 1) of the foot pad 16 (illustrated in FIG. 1) and/or the board magnetic region 14 (illustrated in FIG. 1) of the surfboard 12 (illustrated in FIG. 1). In this embodiment, the pad magnetic region 48 and/or the board magnetic region 14 include permanent or temporary magnets that magnetically interact with the retainer magnetic region 69 to magnetically attract the foot retainer 18 to the foot pad 16. In this embodiment, the retainer magnetic region 69 can be secured to the sole plate 62 in any suitable manner such as with the use of an adhesive (not shown), or with fasteners (not shown), as non-exclusive examples.

Figure 12:
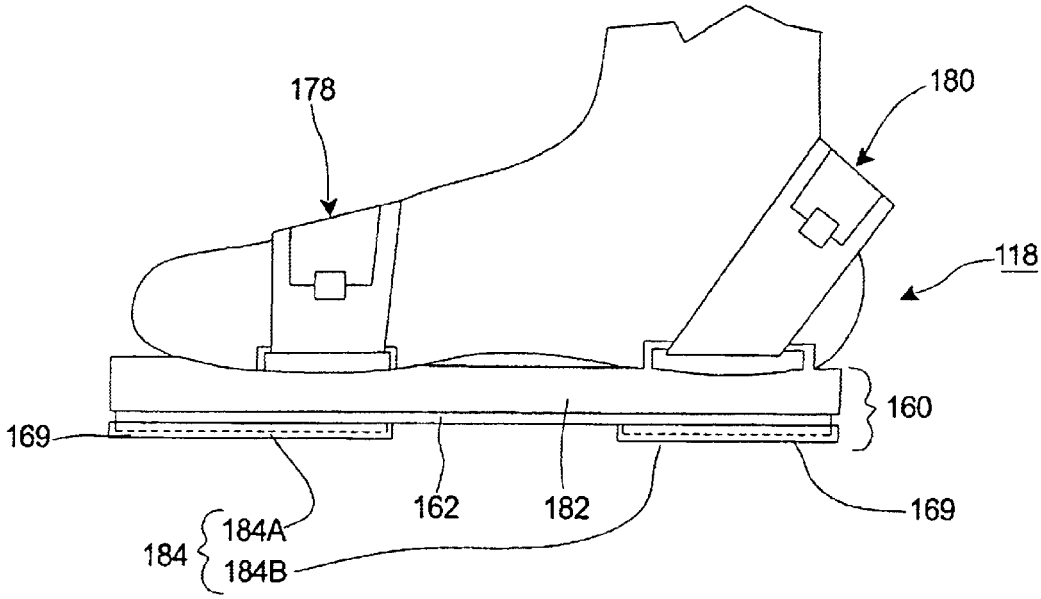
FIG. 12 is a side view of another embodiment of the foot retainer having features of the present invention.

FIG. 12 illustrates another embodiment of a foot retainer 118 including a sole region 160. In this embodiment, the foot retainer 118 does not completely enclose the foot of the individual. Instead, the foot retainer 118 can be open-toed. The foot retainer 118 can include one or more footholds that adjustably secure the foot of the individual to the foot retainer 118. In the embodiment illustrated in FIG. 12, the foot retainer 118 includes a first foothold 178 and a second foothold 180. The footholds 178, 180 can be tightened in various ways. For example, the footholds 178, 180 can utilize a buckle, synthetic fastening materials such as loop and pile materials, or any other suitable fastening means. In alternate embodiments (not shown) the foot retainer can include more or less than two footholds 178, 180. Additionally, either foothold can be the first foothold 178 or the second foothold 180.

Further, the foot retainer 118 illustrated in FIG. 12 includes a retainer base 182, a sole plate 162 and one or more retainer magnetic regions 169 (illustrated in phantom). The retainer base 182 is secured to the footholds 178, 180, and supports the foot of the individual. In an alternate embodiment (not shown) a single retainer base supports both feet of the individual. In this embodiment, the sole plate 162 is secured to the retainer base 182 and the retainer magnetic region 169 is secured to the sole plate 162. The sole plate 162 can have a length that runs along the entire length of the foot of the individual, or the sole plate 162 can be longer or shorter than the foot of the individual.

In addition, the foot retainer 118 can include a removable sole cover 184 that covers at least a portion of the sole region 160. The design of the sole cover 184 can vary. For example, the sole cover 184 can span the entire length of the sole plate 162. In the embodiment illustrated in FIG. 12, the sole cover includes a first cover section 184A and a second cover section 184B. The sole cover 184 can be used while the individual is not surfing in order to protect the sole region 160 from damage. For example, the sole cover 184 can be worn over the sole region 160 during walking, running, etc. The sole cover 184 can be formed from materials such as plastics, rubber, or any other suitably durable materials.

Figure 13:
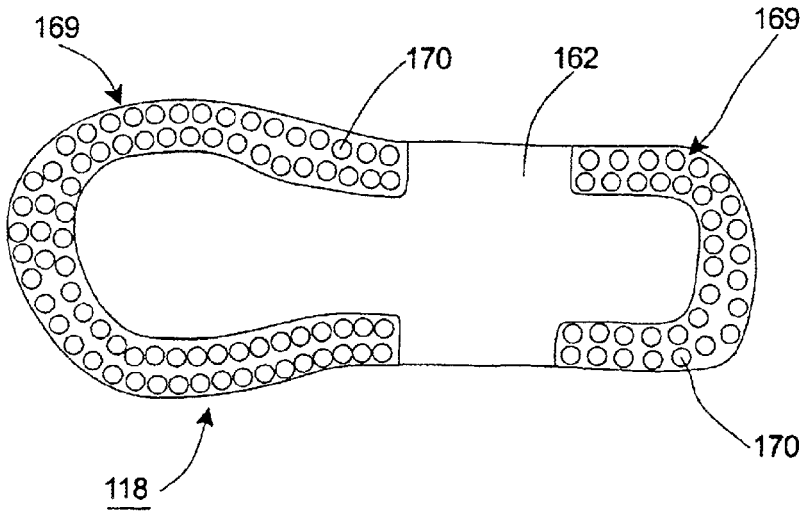
FIG. 13 is a bottom view of a portion of the foot retainer in FIG. 12.

FIG. 13 illustrates a bottom view of the foot retainer 118 in FIG. 12, with the sole cover 184 removed for clarity. In this embodiment, the foot retainer 118 includes the retainer magnetic regions 169 having a plurality of magnets 170. The magnets 170 can be similar to the magnets 70 previously described herein. The magnets 170 can be secured using an epoxy material, plastic, rubber or any other suitable means of securing the magnets 170. In addition to securing the magnets 170, the material used to secure the magnets 170 can also protect the magnets 170 from contact with seawater or other potentially damaging substances.

As shown in FIG. 13, the magnets 170 can be arranged in a double horseshoe configuration. However, any suitable configuration of the magnets 170 can be used. The number, size and positioning of the magnets 170 included in the foot retainer 118 can vary to either increase or decrease the level of magnetization as desired.

The magnets 170 magnetically interact with the pad magnetic region 48 (illustrated in FIG. 1) of the foot pad 16 (illustrated in FIG. 1) and/or the board magnetic region 14 (illustrated in FIG. 1) of the surfboard 12 (illustrated in FIG. 1) to form a magnetic attraction. With this design, the individual wearing the foot retainer(s) 118 can perform various aerobatic stunts while surfing, while the magnetic attraction described herein inhibits separation between the foot retainer 118 and the surfboard 12 and/or the foot pad 16. Further, the magnets 170 can be removable, so that the magnetization level can be adjusted for individuals of different sizes or skill levels, or for varying degrees of difficulty in the aerial tricks being attempted.

While the particular embodiments of the surfboard assembly 10, the surfboard 12, the foot pad 16 and the foot retainer 18 as illustrated herein are fully capable of satisfying the needs and providing the advantages herein before stated, it is to be understood that it is merely illustrative of the presently preferred embodiments of the invention and that no limitations are intended to the details of construction or design herein shown other than as described in the appended claims.

What is claimed is:

1. A surfboard assembly comprising:

a surfboard including a board magnetic region, the board magnetic region including a magnetic material;

a foot pad that is detachably secured to the surfboard, the foot pad including a pad magnetic region including a magnetic material; and a foot retainer including a sole section and a retainer magnetic region that is secured to the sole section, the sole section receiving the foot of an individual, the retainer magnetic region including a magnetic material that generates a magnetic attraction between the foot retainer and at least one of the surfboard and the foot pad.

2. The surfboard assembly of claim 1 wherein the board magnetic region includes a magnet.

3. The surfboard assembly of claim 1 wherein the retainer magnetic region has a surface that faces a surface of the board magnetic region during the magnetic attraction, the surface of the board magnetic region having a surface area greater than a surface area of the surface of the retainer magnetic region.

4. The surfboard assembly of claim 1 wherein the pad magnetic region magnetically interacts with the board magnetic region to form a magnetic attraction between the foot pad and the surfboard.

5. The surfboard assembly of claim 4 wherein during use of the surfboard, an individual exerts force on the foot pad, and wherein the foot pad remains secured to the surfboard when the individual no longer exerts force on the foot pad.

6. The surfboard assembly of claim 1 wherein the board magnetic region has a surface that faces a surface of the retainer magnetic region when a magnetic attraction is formed between the retainer magnetic region and the board magnetic region, the surface of the board magnetic region having a greater surface area than the surface of the retainer magnetic region.

7. The surfboard assembly of claim 1 wherein the surfboard has a top board surface that is substantially uninterrupted by the board magnetic region.

8. The surfboard assembly of claim 7 wherein at least a portion of the magnetic attraction occurs along the top board surface.

9. The surfboard assembly of claim 7 wherein the surfboard includes a body region that is interior to the top board surface, and at least a portion of the magnetic attraction occurs within the body region.

10. A surfboard assembly used by an individual, the surfboard assembly comprising:

a surfboard;

a foot pad including a pad region that is formed from a resilient material and a pad magnetic region that is secured to the pad region, the pad magnetic region including a magnetic material, wherein one of the pad region and the pad magnetic region secures the foot pad to the surfboard to provide a slip-resistant surface for the surfboard, the individual exerting force on the foot pad while surfing, the foot pad remaining secured to the surfboard when the individual no longer exerts force on the foot pad; and a foot retainer including a retainer magnetic region that is formed from magnetic material, the foot retainer having a surface that faces a surface of the foot pad, the surface of the foot retainer having a surface area that is less than a surface area of the surface of the foot pad, a magnetic attraction being formed between the retainer magnetic region and one of the foot pad and the surfboard.

11. The surfboard assembly of claim 10 wherein the foot pad is detachably secured to the surfboard.

12. The surfboard assembly of claim 10 wherein the surfboard includes a board magnetic region that is magnetically attracted to one of the foot pad and the foot retainer.

13. The surfboard assembly of claim 12 wherein the surfboard has a top board surface that is substantially uninterrupted by the board magnetic region.

14. The surfboard assembly of claim 12 wherein the surfboard includes a body region that is interior to the top board surface, and at least a portion of the magnetic attraction occurs within the body region.

15. The surfboard assembly of claim 12 wherein the board magnetic region includes a magnet.

16. A surfboard for use with a foot retainer that retains a foot of an individual, the foot retainer having a retainer magnetic region including a magnetic material, the retainer magnetic region having a surface, the surfboard comprising:

an interior body region;

an exterior surface layer that at least partially encircles the body region, the surface layer having an outer surface that faces away from the body region; and a first board magnetic region that is coupled to the surface layer, the first board magnetic region including a magnetic material that at least partially forms a magnetic attraction between the surfboard and the foot retainer, the first board magnetic region having a top surface that faces away from the surface layer and substantially toward the surface of the retainer magnetic region, the top surface having a surface area that is greater than a surface area of the surface of the retainer magnetic region, the first board magnetic region extending away from the surface layer so that the top surface of the first board magnetic region is substantially non-coplanar with outer surface of the surface layer.

17. The surfboard of claim 16 wherein the board magnetic region has a substantially planar configuration.

18. The surfboard of claim 16 wherein the board magnetic region includes a magnet.

19. The surfboard of claim 16 further comprising a spaced apart, second board magnetic region that is coupled to the surface layer, the second board magnetic region being at least partially formed from a magnetic material.

20. A surfboard assembly including a foot retainer and the surfboard of claim 16, the foot retainer magnetically interacting with the board magnetic region of the surfboard to form a magnetic attraction between the foot retainer and the surfboard.

21. The surfboard assembly of claim 20 wherein the foot retainer includes a magnet that magnetically attracts the surfboard to the foot retainer.

22. The surfboard assembly of claim 20 further comprising a retainer body that receives the foot of the individual, and a sole plate that that couples the retainer magnetic region to the retainer body.

23. The surfboard assembly of claim 20 wherein the retainer magnetic region includes a magnet.

24. The surfboard assembly of claim 20 further comprising removable sole cover that is selectively positioned to cover at least a portion of the retainer magnetic region.

25. A method for surfing comprising the steps of:

detachably securing a foot pad having a pad magnetic region that includes a magnetic material to a surfboard that includes a board magnetic region having a magnetic material; and magnetically attracting a retainer magnetic region of a foot retainer that retains the foot of an individual to at least one of the surfboard and the foot pad so that the individual is detachably coupled to the surfboard.

26. The method of claim 25 wherein the step of detachably secureing includes the board magnetic region having a magnet.

27. The method of claim 25 wherein the step of magnetically attracting includes the retainer magnetic region having a surface that faces a surface of the board magnetic region during the magnetic attraction, wherein the surface of the board magnetic region has a surface area that is greater than a surface area of the surface of the retainer magnetic region.

28. The method of claim 25 wherein the step of detachable securing includes the surfboard having a top board surface that is substantially uninterrupted by the board magnetic region.

29. A method for surfing comprising the steps of:

securing a foot pad to a surfboard, the foot pad having a pad region and a pad magnetic region that is secured to the pad region, the pad magnetic region including a magnetic material;

forming a magnetic attraction between retainer magnetic region of a foot retainer and one of the foot pad and the surfboard, the retainer magnetic region being formed from magnetic material; and facing a surface of the foot retainer substantially toward a surface of the foot pad, the surface of the foot retainer having a surface area that is less than a surface area of the surface of the foot pad.

30. The method of claim 29 wherein the step of securing includes detachably securing the foot pad to the surfboard.

31. The method of claim 29 wherein the step of forming includes forming a magnetic attraction between a board magnetic region of the surfboard and one of the foot pad and the foot retainer.

32. A method for surfing comprising the steps of:

providing a surfboard including an interior body region that is at least partially encircled by an exterior surface layer having an outer surface that faces away from the interior body region, and a board magnetic region that is coupled to the exterior surface layer, the board magnetic region having a top surface that faces away from the surface layer, the board magnetic region extending away from the surface layer so that the top surface is substantially non-coplanar with outer surface of the surface layer;

retaining the foot of an individual with a foot retainer having a retainer magnetic region, the retainer magnetic region being formed from a magnetic material, the retainer magnetic region having a surface that substantially faces the board magnetic region;

sizing the top surface of the board magnetic region to have a surface area that is greater than a surface area of the surface of the retainer magnetic region; and magnetically attracting the board magnetic region and the retainer magnetic region to one another.

33. The method of claim 32 wherein the step of providing includes the board magnetic region having a substantially planar configuration.

34. The method of claim 32 wherein the step of providing includes the board magnetic region including a magnet.

35. The method of claim 32 wherein the step of magnetically attracting includes the retainer magnetic region having a magnet that is magnetically attracted to the board magnetic region.

36. The method of claim 32 wherein the step of retaining includes the steps of (i) retaining the foot of the individual with a retainer body of the foot retainer, and (ii) coupling the retainer magnetic region to the retainer body with a substantially rigid sole plate.

* * * * *